United States Patent [19]

Marsee

[11] 3,985,838

[45] Oct. 12, 1976

[54] HIGH VELOCITY CARBURETOR

[75] Inventor: Frederick J. Marsee, Clawson, Mich.

[73] Assignee: Ethyl Corporation, Richmond, Va.

[22] Filed: Mar. 20, 1973

[21] Appl. No.: 343,097

Related U.S. Application Data

[62] Division of Ser. No. 157,087, June 28, 1971, Pat. No. 3,768,787.

[52] U.S. Cl. ..... 261/44 R

[51] Int. Cl.[2] ..... F02M 9/06

[58] Field of Search ..... 261/44 R

[56] References Cited

UNITED STATES PATENTS

| | | | |
|---|---|---|---|
| 2,841,373 | 7/1958 | Broge | 261/44 R |
| 3,069,146 | 12/1962 | MacNeill | 261/44 R |
| 3,210,055 | 10/1965 | Kingsley | 261/50 A |
| 3,310,045 | 3/1967 | Bartholomew | 261/23 A |

*Primary Examiner*—Tim R. Miles

*Attorney, Agent, or Firm*—Donald L. Johnson; John F. Sieberth; Robert A. Linn

[57] ABSTRACT

A multibarrel, high velocity carburetor comprising at least one primary barrel having a conventional venturi construction and at least one secondary barrel which has a cross-sectional area greater than that of the primary barrel and which has means for varying this cross-sectional area in response to engine demand; and its use in a low exhaust emission, spark ignition internal combustion engine system of the lean reactor type, to effect improved driveability. A preferred carburetor has one primary barrel and two variable secondary barrels. A fuel enrichment device is provided which comprises a vane pivotally mounted in the variable venturi section and adapted to incline inwardly to further restrict the venturi cross-section when intake manifold vacuum drops.

7 Claims, 7 Drawing Figures

HIGH VELOCITY CARBURETOR

CROSS REFERENCE TO RELATED APPLICATION

This application is a division of copending application U.S. Ser. No. 157,087, filed June 28, 1971 now U.S. Pat. No. 3,768,787.

BACKGROUND OF THE INVENTION

Ordinary spark-ignition internal combustion engines utilize a carburetor/intake manifold combination as part of their fuel system. In the carburetor, air and fuel are blended and fed into the intake manifold for distribution to the cylinder or cylinders. In order to ensure good engine operation, the air:fuel mixture is kept near and usually slightly higher than the stoichiometric ratio. The use of such rich fuel:air mixtures contributes to undesirable unburned hydrocarbon and carbon monoxide exhaust emissions. Operating an engine using air:fuel mixtures greater than stoichiometric, commonly called a lean mixture, will result in reduction of exhaust hydrocarbon emissions. The ordinary carburetor, however, although capable of providing lean mixtures, is inadequate because (1) it cannot provide these lean mixtures for all engine operating conditions, (2) its fuel/air mixing capability is relatively poor for lean mixtures, and (3) it is ordinarily limited to providing fuel/air ratios down to only about 1:15.5. There are carburetors available, (e.g. Delco-Rochester's "Quadra Jet"; also, see U.S. Pat. No. 3,310,045, to E. Bartholomew) which do effect good air/fuel mixing at relatively lean air/fuel ratios. However, such carburetors are somewhat limited in their capacity to provide sufficient air/fuel mixture for high engine demand; these carburetors are relatively complex in structure; and finally, their air/fuel blending characteristics for lean mixtures, for example, air/fuel of 18:1 and higher, may not be adequate for good engine performance. These carburetor limitations in general have an adverse effect on the driveability of an automobile — especially where the engine is equipped with other exhaust emission reducing modifications such as catalytic converters, thermal reactors, etc.

The present invention provides a carburetor of novel design and relatively simple construction featuring a combination of at least one primary barrel of conventional venturi construction and at least one secondary barrel having a cross-sectional area larger than the first barrel and having means whereby the cross sectional area can be varied in response to engine demand. This carburetor affects excellent air/fuel mixing over a wide range of air:fuel ratios, especially in the leaner air:fuel ratios, i.e. 16:1 – 18:1. The variable cross sectional area secondary barrel feature provides sufficient capacity for the carburetor to ensure adequate air:fuel supply to be provided to an engine even a high engine demand. Use of the carburetor of the present invention on a conventional internal combustion engine improves the efficiency of such an engine and reduces undesirable exhaust emissions, especially the hydrocarbons and carbon monoxide. Furthermore, when the present carburetor is used in place of currently available carburetors, with an engine which is modified to further decrease exhaust emissions, for example, with a catalytic converter or a lean reactor system, the driveability of an automobile powered with this new combination is significantly improved.

SUMMARY OF THE INVENTION

A multibarrel carburetor comprising at least one primary barrel having conventional venturi construction and at least one secondary barrel which has a cross-sectional area greater than that of the primary barrel and which has slidable means for adjusting this cross-sectional area said adjustment being responsive to engine demand via a vacuum signal, whereby improved fuel/air blending, especially at leaner than stoichiometric fuel/air ratios is effected. In the variable cross-sectional area barrel, the improvement which consists of an enrichment means to provide additional fuel required at rapid acceleration.

A low exhaust emission, lean reactor engine system having improved driveability characteristics.

DESCRIPTION OF THE PREFERRED EMBODIMENTS

Figure 1:
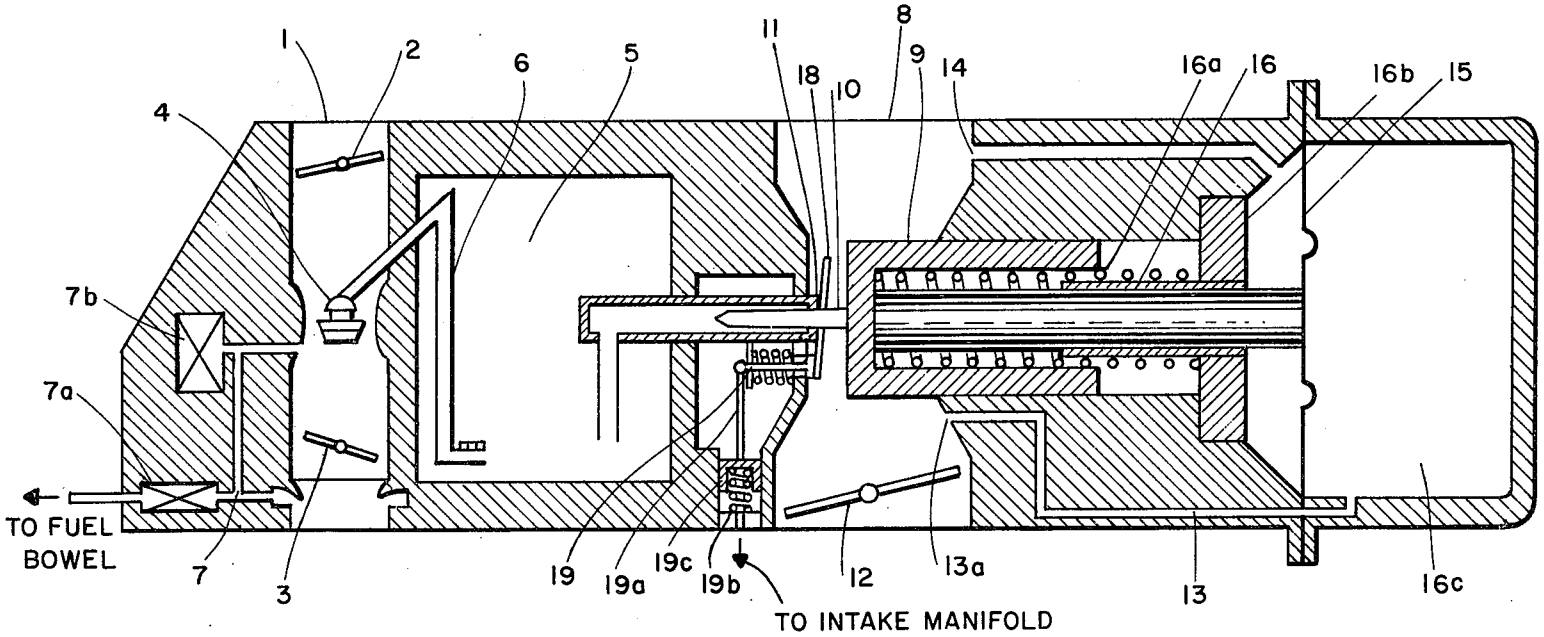
FIG. 1 is a partial section through a schematic illustration of the carburetor of the present invention.

A preferred embodiment of this invention is a multibarrel, multistage carburetor for a spark ignition internal combustion engine which comprises a. at least one primary barrel which includes
   1. a first mixing conduit having a venturi,
   2. a fuel nozzle situated in said venturi to deliver fuel to said first conduit,
   3. a first throttle means mounted in said conduit downstream of said fuel nozzle, said throttle means being manually moveable between opened and closed positions,
   4. choke means situated in said first conduit upstream of said nozzle, said choke means being mounted in said conduit to permit manual movement between closed and opened positions,
   5. a vacuum modulated throttle by-pass which provides required enrichment of and increase in amount of mixture during engine deceleration, and b. at least one secondary barrel, having no choke means, which includes
   6. a second mixing conduit having a cross-sectional area larger than said first mixing conduit,
   7. a second throttle means rotatably mounted in said second conduit to permit manual movement between closed and opened positions, said second throttle means being directly linked to said first throttle means so that said second throttle means begins to open when said first throttle means reaches a pre-determined open position, 8. slidably adjustable means situated above said second throttle means, and being positioned to move across the short axis of and into said second conduit, said slidably adjustable means (1) having a needle axially attached to the end of said slidably adjustable means which enters said conduit, and (2) being attached to a vacuum operator at the end opposite said needle, said vacuum operator being responsive to a vacuum signal obtained at a point in said second conduit just above said second throttle means,
9. a fuel orifice for providing fuel to said second conduit, situated in said second conduit upstream of said second throttle means and opposite said slidably adjustable means, the extent of said fuel orifice opening being controlled by the movement of said needle into and out of said orifice as said slidably adjustable means responds to said vacuum operator,
10. a fuel/air mixture enrichment means which comprises a vane situated in and substantially parallel to the long axis of said second conduit, said vane being responsive to manifold vacuum and acting to reduce the cross-section area of said second conduit in the region of the slidably adjustable means at high engine loads, or at any engine operating mode where the intake manifold vacuum is low, said primary barrel providing fuel/air mixture to said engine at idle and relatively low engine loads and combining with said second barrel to provide fuel/air mixture to said engine at higher engine load. A carburetor having one primary and two secondary barrels is a more preferred embodiment.

Another embodiment of this invention is an improved "lean reactor" engine system having enhanced driveability characteristics featuring the use of a three-barrel carburetor of the present invention. By "lean reactor" is meant an engine system which utilizes lean air/fuel mixtures and exhaust heat conservation means to reduce undesirable exhaust emissions.

Figure 4:
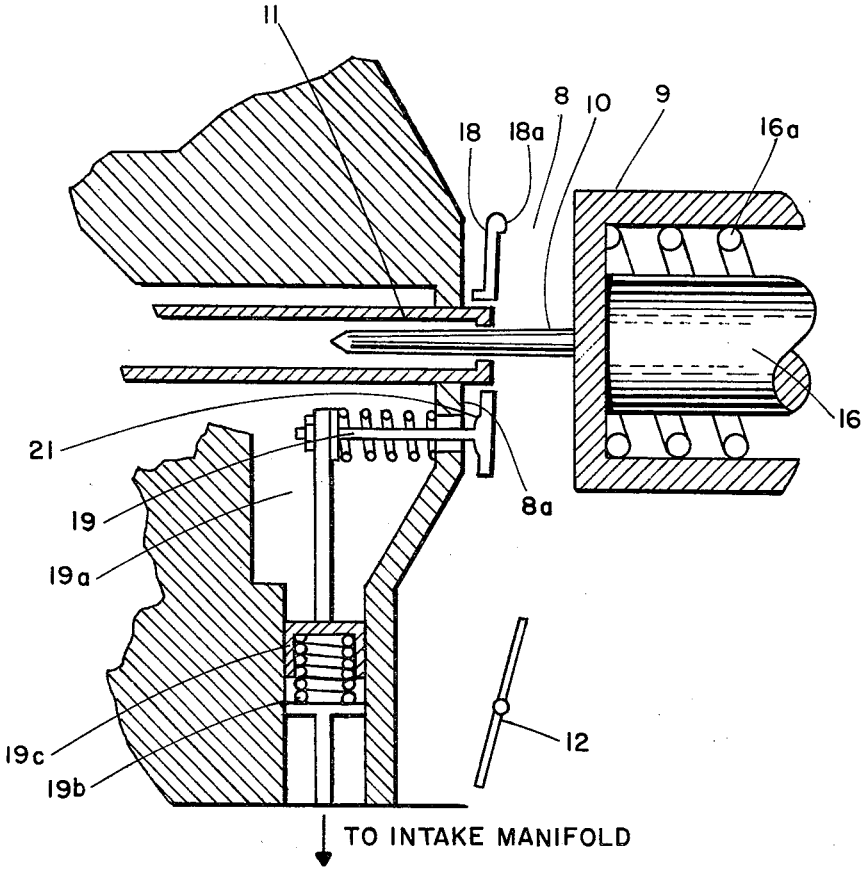
FIG. 4 is an expanded view of the fuel orifice portion of FIG. 1, secondary barrel, at part throttle.
Figure 5:
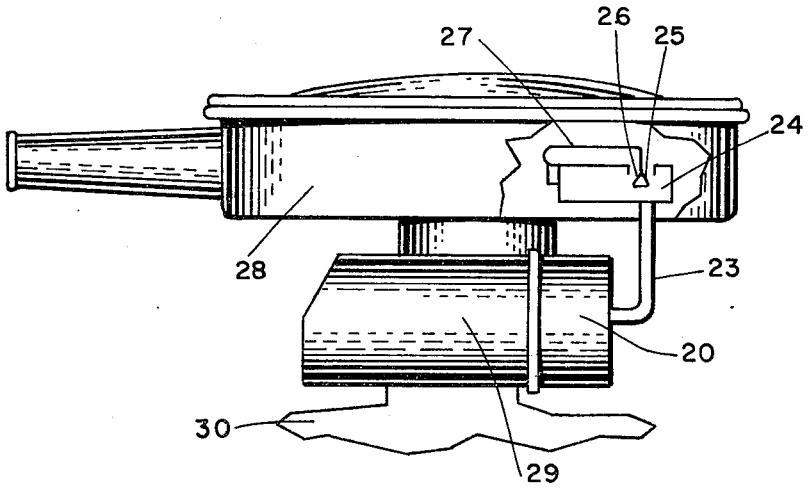
FIG. 5 is a schematic illustration showing a temperature responsive means for controlling opening of the secondary barrel before warm-up.
Figure 6:
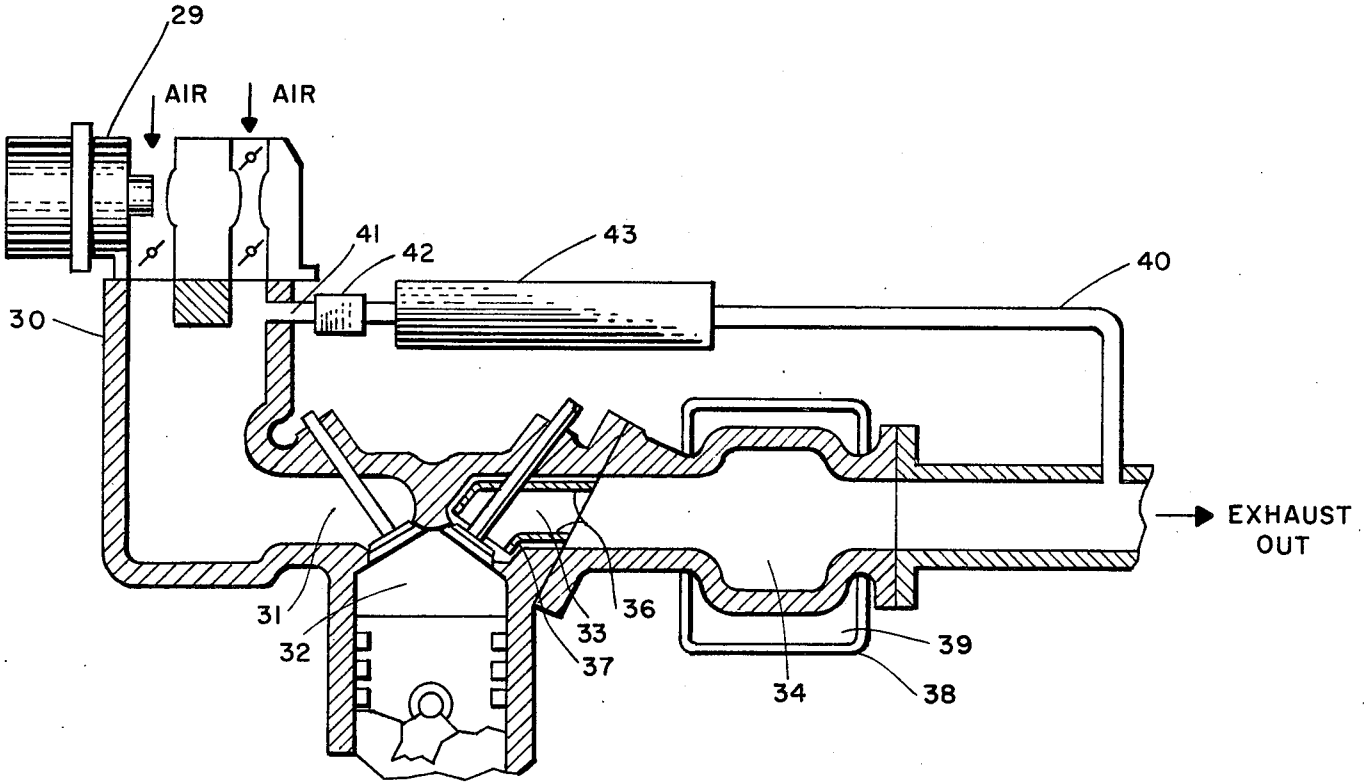
FIG. 6 is a schematic illustration, in partial section, of a preferred internal combustion engine system which utilizes the carburetor of FIG. 3.

Construction and operation of the present carburetor and engine system will be better understood by considering the device as illustrated in the accompanying FIGS. 1–6. The same number is used to designate the same elements in all of the drawings. FIG. 1 is a schematic illustration of the carburetor of the present invention. The primary barrel 1 is of conventional venturi configuration, but of relatively small diameter. It has a conventional choke means 2 above the fuel nozzle 4 and a throttle plate 3 below said nozzle 4. The choke means can be of conventional design with the conventional bimetal coil thermostatic control. The choke means may additionally be ambient temperature modulated by means such as described in U.S. Pat. No. 2,970,825; or in my copending application Ser. No. 80,106, filed Oct. 12, 1970 now U.S. Pat No. 3,785,624. The nozzle 4 may be of any conventional design; the illustration shows a nozzle having a step design of the type described in U.S. Pat No. 3,472,495. Such a nozzle permits better fuel/air mixing as well as improved flow under idle conditions. The throttle plate 3 may be of conventional design, but is preferably perforated. A perforated throttle plate also improves fuel/air mixing and permits operation of the engine at idle without necessitating a separate idle fuel system. Conduit 7 and control valve means **7*a* and 7*b* comprise a conventional throttle by-pass system. The conventional control valve 7*b* is responsive to a manifold vacuum signal and in turn controls valve 7*a* which permits air/fuel mixture to by-pass throttle 3 while said throttle 3 is closed or is being closed, during idle and/or deceleration. This by-pass system reduces the necessity for excess air/fuel enrichment which occurs with ordinary carburetor idle systems during idle and deceleration engine modes. Although the dimensions are not critical, the cross section of the primary barrel venturi conduit 1 is preferably small enough to effect relatively high air velocities of 60–400 feet per second (fps) with air velocities of about between 60 and 80 fps and higher being especially desirable. By maintaining such air velocity in the primary barrel, sufficient suction is obtained in the fuel nozzle 4 area so that it (the nozzle) meters fuel from fuel bowl 5 via fuel conduit 6 during idle operation. Thus, only the primary barrel 1 provides fuel during idle and low engine demand modes of operation. Some exhaust can be recycled into the intake manifold along with the air/fuel mixture from the primary barrel. FIG. 6**, which is discussed below, illustrates a suitable exhaust recycle arrangement. This recycling of exhaust reduces nitrogen oxide levels in emitted exhaust.

The secondary barrel conduit 8 has a cross section which is larger than that of the primary barrel 1. Extending into the secondary barrel (or conduit) 8 is a slidably adjustable means 9 for varying the secondary barrel cross section. FIG. 1 illustrates this slidably adjustable means 9 to be a cylinder. This is not meant to limit this slidably adjustable means. Such means might be a plate, hemicylinder, or a movable element of any other configuration, provided it has sufficient rigidity to withstand deflection which might be caused by the high velocity air moving through said secondary conduit 8. One end of said slidably adjustable means 9 is attached via structural member 16 to a diaphragm 15. A spring **16*a* is set inside slidably adjustable means 9 and against stop 16*b*. To the other end of slidably adjustable means 9 there is attached a needle valve 10. The needle valve 10 is positioned in the secondary barrel 8 so that it moves in and out of fuel orifice 11 in order to meter fuel into said secondary barrel 8. The slidably adjustable means 9 responds to a vacuum signal obtained through an opening 13*a* just above throttle 12, which signal is conducted into the chamber 16*c*, via conduit 13. The port 14 is open to the atmosphere to vent the space 14*a* in front of the diaphragm 15. The signal thus obtained acts on the diaphragm 15 which in turn moves the slidably adjustable means 9 out of said secondary barrel 8. The spring 16*a* operates to return said slidably adjustable means 9 as the vacuum in chamber 16*c* decreases. In operation, when the throttle 12 is closed, there is no vacuum signal and the slidably adjustable means 9 and needle valve 10 are urged forward by the spring 16*a*, thus closing the fuel orifice 11. As the throttle 12 is opened, a vacuum signal is obtained and acts on the diaphragm 15. The spring 16*a* which maintains the slidably adjustable means 9 in a closed position when throttle 12 is closed, may be set to maintain any desired vacuum in chamber 16*c*; a setting conveniently used is one which provides a vacuum or pressure drop of 1.3 to 1.6 inches of mercury. Consequently, the air velocity in the secondary barrel 8** is kept relatively constant and generally at about 300 feet per second, when this barrel is in operation.

The needle valve 10 in the secondary barrel 8 moves into and out of the fuel orifice 11 as engine demand requires, that is, as the throttle 12 in the secondary barrel is opened. This needle valve 10 is necessarily tapered in order to effect good fuel metering control. The secondary barrel can operate with no other elements than these already described. However, in order to improve the performance characteristics of an engine which utilizes the present carburetor, a fuel enrichment means embodied in the vane 18 and its attendant control system elements 19, 19*a*, 19*b*, and 19*c* is provided. This vane 18 is situated in the secondary barrel 8 in position to span the area around fuel orifice 11. It has an opening through which the needle valve 10 extends into the fuel orifice 11. A detailed explanation of the structure and operation of this enrichment vane will be presented below when discussing FIGS. 3, 3*a*, and 3*b*. The throttle 3 and primary barrel 1 and throttle 12 and secondary barrel 8 are mechanically linked (linkage not illustrated) so that the primary throttle is opened first to provide fuel/air mixture at idle and low power demand while the second throttle 12 is kept closed; and then when the first throttle 3 is opened about 40°/o, the linkage actuates the second throttle 12 which then begins to open to supply the additional air/fuel required for higher engine power demand. This mechanical linkage is ao arranged that the rate of opening of said second throttle 12 is gradually reduced from initial opening to full open. Although FIG. 1 schematically illustrates one primary barrel and one secondary barrel, combinations involving one or more primary barrels and more than one secondary barrel come within the scope of this invention.

Figure 2:
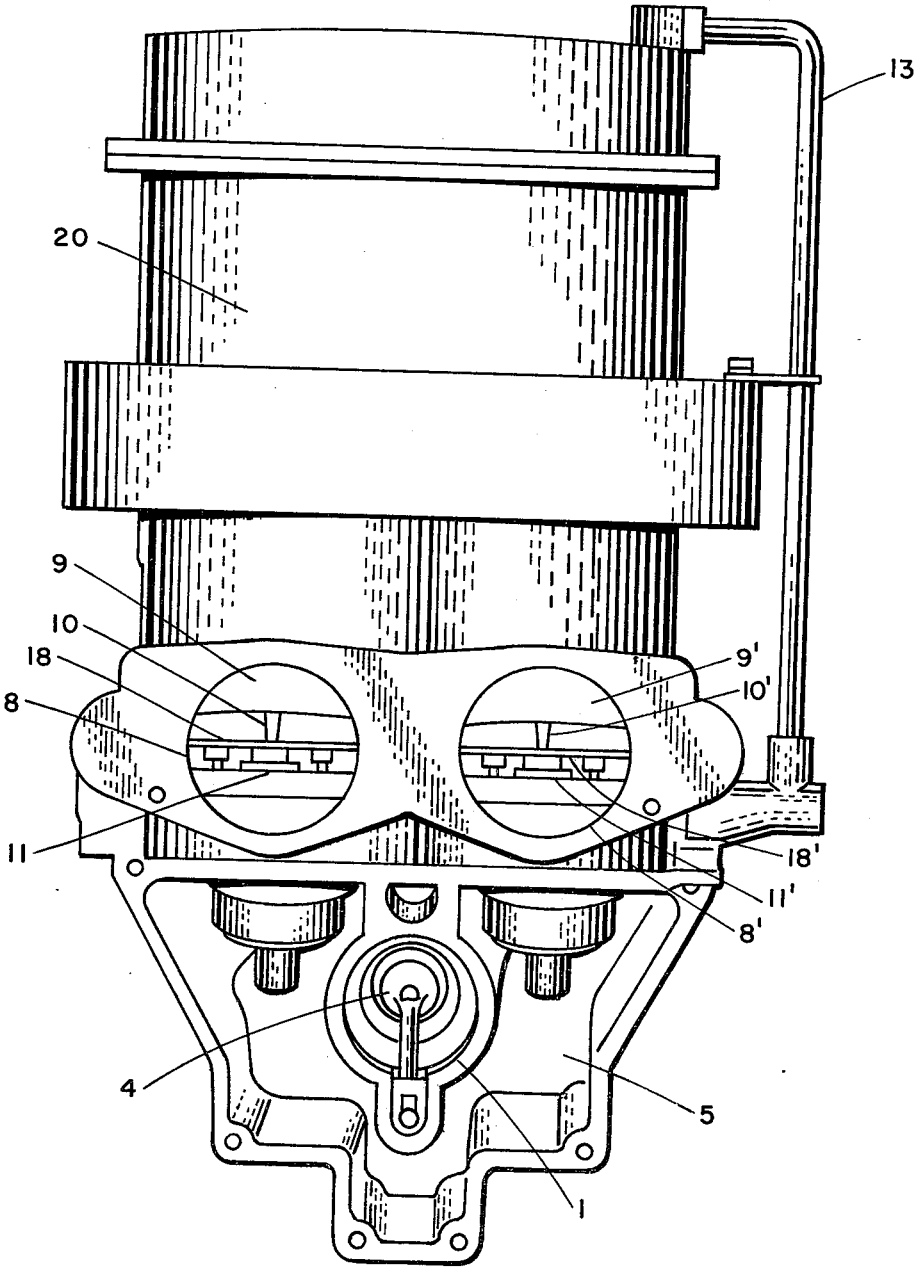
FIG. 2 is a top view of a partial section of a carburetor illustrated in FIG. 1, but having one primary barrel and two secondary barrels.

FIG. 2 is a top view in partial section of a carburetor of the present invention having two secondary barrels 8 and 8' and one primary barrel 1. The secondary barrels 8 and 8' are in parallel. The slidably adjustable means 9 and 9' in each of these barrels are illustrated with the needle valves 10 and 10' partially inserted into the fuel orifices 11 and 11', respectively. Each of the two secondary barrels has an enrichment vane 18 and 18'. Each slidably adjustable means 9 and 9' is attached to a separate diaphragm; but only one vacuum chamber (enclosed in housing 20 and controlled via a vacuum signal through an externally mounted conduit 13) serves to control both slidably adjustable means. The conduit 13 by which the vacuum signal is transmitted to the vacuum chamber is shown to be external of the carburetor housing. Although not shown, a common enrichment vane control system (shown as 19, 19*a*, 19*b*, and 19*c* in FIG. 1) is used to control both enrichment vanes 18 and 18'. Individual vacuum chamber and individual enrichment vane control systems could be utilized if desired; but since both secondary barrels operate simultaneously, the common vacuum chamber and enrichment vane control system is simpler, more efficient and preferred. This three-barrel arrangement is also a preferred embodiment of the present invention.

Figure 3:
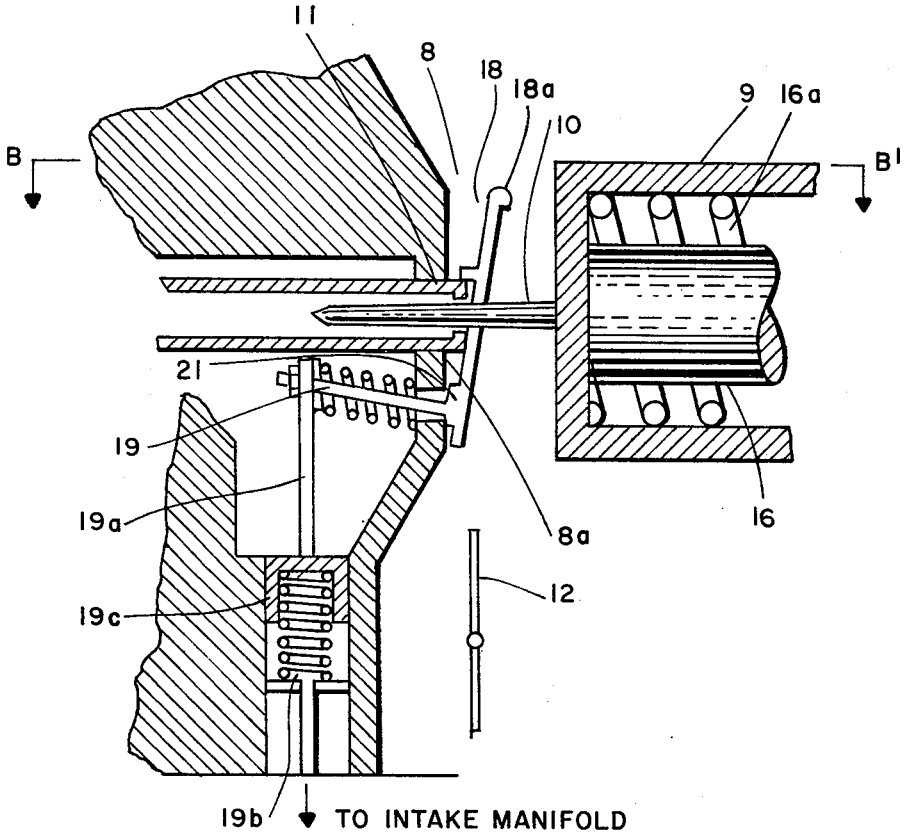
FIG. 3 is an expanded view of the fuel orifice portion of FIG. 1, secondary barrel, at full throttle.

FIG. 3 is an enlarged view of the fuel orifice portion of the secondary barrel illustrated in Example 1, showing the enrichment vane 18 and the control elements 19, 19*a*, 19*b*, and 19*c*, at full throttle. In the absence of manifold vacuum the piston 19*c* is urged up by spring 19*b*. This movement of the piston 19*c* upward causes the control arm 19*a* to push lever arm 19 attached to vane 18 at point 21 up, thus urging the bottom edge of the enrichment vane 18 inwardly, to rest against the barrel 8 surface on attachment point 21, causing the leading edge of vane 18 to move out into the secondary barrel conduit 8. This effectively reduces the cross-sectional area through which air passes between the slidably adjustable means 9 and the enrichment vane 18, thereby causing an increase in the vacuum signal which control said slidably adjustable means 9. In response to this increased vacuum signal, the needle valve 10 attached to the slidably adjustable means 9 moves further out of the fuel orifice 11, thereby causing additional fuel to flow into the secondary barrel 8, thus enriching the air/fuel mixture passing through said secondary barrel 8. This means of enriching the air/fuel mixture corrects for the lag in response of the secondary barrel slidably adjustable means which is called for when there is a sudden demand placed on the secondary barrel, such as, for example, when the accelerator pedal is rapidly and/or fully depressed. This enrichment device thus provides the additional fuel which is called for by a rapid acceleration demand and significantly improves the engine driveability. Without such an enrichment device, there is a noticeable response lag when rapid acceleration demand is made and consequent impairment in the driving quality of a vehicle driven by an engine using the present carburetor. The leading edge of vane 18 is illustrated as having a lip 18*a*. This configuration of the leading edge of the vane 18 reduces the tendency to cause laminar flow and thereby prevents the fuel out of orifice 11 from running down against the barrel wall at 8*a*. A vane having no lip or equivalent protrusion at its leading edge can be used, if desired. However, the lipped configuration is preferred since it improves fuel flow, increases turbulence and improves fuel/air mixing.

Figure 3A:
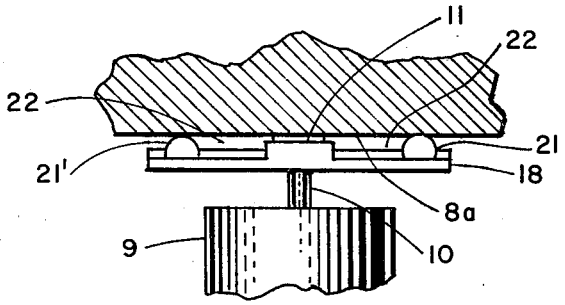
FIG. 3A is a top view through a section of the FIG. 3 illustration.

FIG. 3A is a top view of FIG. 3 section through B, B'. This view shows that vane 18 rests on two points of attachment 21 and 21' and slightly away from the wall of the barrel 8. This provides a narrow opening 22 which allows air to pass through and vaporize any fuel which might run down from the orifice 11 along the barrel 8*a* wall.

FIG. 4 is an enlarged view of the same portion of the secondary barrel as illustrated in FIG. 3, except that the manifold vacuum has been increased, as under part throttle conditions, and the control piston 19*c* has now been pulled downward, compressing spring 19*b*. The lower edge of the enrichment vane is thus positioned away from the barrel 8 wall and the leading edge of said vane 18 is moved back towards the barrel 8 wall. This is normally the position that the vane 18 will be in when there is no rapid acceleration demand.

FIG. 5 illustrates a temperature responsive bleed valve for controlling the vacuum in the vacuum chamber which controls the secondary barrel(s) cross-section area of the present carburetor while the engine is being warmed up. The FIG. 5 illustration shows the bleed valve 26 connected via conduit 23 to the vacuum chamber housing 20 of a three-barrel carburetor of the type illustrated in FIG. 2 mounted in an engine intake manifold 30. The temperature control bleed valve means comprises a simple chamber 24 having an opening 25 in which a valve 26 is situated. The valve is in turn attached to a bimetal element 27 which responds to the air temperature inside the air cleaner housing 28. When the air in the housing 28 is below the normal engine operating temperature, the valve 26 is opened and bleeds vacuum from the carburetor vacuum chamber. This tends to prevent excess fuel being metered into the secondary barrel while the engine is warming up. Once the air in the air cleaner 28 reaches normal engine operating temperature, the bimetal element 27 moves the valve 26 to close the orifice 25, thus sealing the bleed valve. When the bleed valve 27 is closed, the carburetor functions in the manner set out above. FIG. 5 shows the temperature control bleed valve mounted in the air cleaner. This is a convenient and preferred position for this element. The bimetal control means, however, can be mounted anywhere that it can sense and respond to the engine operating temperature.

FIG. 6 schematically illustrates a preferred engine system using a three-barrel carburetor of the present invention. The basic system is described in U.S. Pat. No. 3,577,727, to F. Marsee and J. A. Warren; and the system has been and is herein referred to as the lean reactor system. The carburetor 29 is of the three-barrel type illustrated in FIG. 2. It is conventionally mounted on the intake manifold 30. Air/fuel mixture is fed through the carburetor 29 into the intake manifold 30 which in turn supplies the air/fuel mixture through intake port 31 to the combustion chamber 32. On being ignited, the air/fuel mixture provides energy and forms exhaust products, or simply, exhaust. This exhaust passes through the exhaust port 33 into the exhaust manifold 34, then into the exhaust pipe 35 and finally out into the atmosphere. The exhaust port 33 is insulated by means of a metal liner 36 which forms an insulating air space 37. The exhaust manifold 34 is also insulated by means of a metal shroud 38 which defines an insulating air space 39. This air space 39, if desired, can contain other insulating material, e.g., asbestos, metal foam, fiberglas insulation and the like. A portion of the exhaust is recycled via conduit 40 to a point 41 in the intake manifold 30 just below the primary barrel 1 of carburetor 29. It is preferred to obtain the exhaust for recycle at a point in the exhaust system beyond the exhaust manifold 34. However, exhaust for recycle can be obtained at any other desired point in the exhaust portion of the system. The quantity of exhaust which is recycled is controlled by valve means 42. Although this valve means 41 may be controlled mechanically or electrically, valve means responsive to a manifold vacuum signal is preferred. A most preferred exhaust recycle control system is described in my concurrently filed application herewith. By recycling exhaust in this manner, a substantial reduction in total nitrogen oxides in the exit exhaust is achieved. A heat exchange means 43 is also provided to cool the recycle exhaust before it is introduced into the intake manifold 30. Any suitable heat exchange device or construction can be used. Although not shown in FIG. 6, a catalytic converter and/or a back pressure control valve may also be provided in the engine exhaust system if desired.

The multistage, multibarrel carburetor of the present invention can be used with a conventional internal combustion engine having a conventional induction system and exhaust system. Use of the carburetor in such a system will effect improved air/fuel mixture uniformity, especially with lean mixtures, that is, mixtures in which the amount of air is greater than the stoichiometric amount of air required for complete combustion of the fuel (e.g. air:fuel ratios of 16:1 and greater), and distribution of this air/fuel mixture uniformly to all the cylinders in a multicylinder engine will be facilitated. Because of the improved air/fuel blending, the combustion efficiency of the engine is improved and unburned hydrocarbons and carbon monoxide emitted in the exhaust are reduced. Although other multibarrel carburetors and especially three-barrel carburetors, will provide good lean air/fuel mixtures (see U.S. Pat. No. 3,310,045, to E. Bartholomew), the present carburetor, especially the preferred three-barrel embodiment, significantly improves the driveability of an automobile powered by an engine which uses the present carburetor.

The carburetor of the present invention can also be used in a system of the type described in U.S. Pat. No. 3,577,727. This patent describes a system for reducing exhaust emissions from an internal combustion engine which comprises combination of (1) a fuel induction system to provide a lean air/fuel mixture, (2) means of conserving the exhaust heat, and (3) a back pressure control valve. Use of a three-barrel carburetor of the present type, in the fuel induction portion of the combination described above, either with or without the back pressure element (3) enhances the overall efficiency of the aforesaid system; and substantially improves the driveability of an automobile which utilizes such an engine system. To illustrate the effectiveness of this latter combination (that is, without the back pressure control valve) in maintaining low hydrocarbon, carbon monoxide emissions, the following emission ranges can be maintained by a standard V8 engine equipped with (a) the present three-barrel carburetor/intake manifold induction system and (b) some of the elements for conserving exhaust heat described in U.S. Pat. No. 3,577,727 (and illustrated in FIG. 6).

| Test Method | Exhaust Emissions | | |
|---|---|---|---|
| | Hydrocarbons | Carbon Monoxide | Nitrogen Oxides |
| California 7-Mode Cycle test | <30 ppm | <.4 % | <300 ppm |
| Federal Vehicle Exhaust Test Procedure, Subpart H (1) | 0.6 – 1 gram/mile | 6 – 10 gram/mile | 1 – 2 gram/mile |

(1) Described in Federal Register, Volume 35, No. 219, November 10, 1970

More importantly, the driveability of a standard automobile equipped with such an engine system is excellent. This has been verified by extensive road testing and rating of such an automobile by qualified personnel. By standard automobile is meant a current model of a regular production automobile.

The present invention is embodied in (a) a multistage, multibarrel carburetor which comprises a high velocity primary section and an essentially constant and high velocity, variable venturi secondary section; (b) air/fuel mixture enrichment means in the secondary section for improved fuel control; and (c) a combination using the present engine carburetor with elements of an exhaust emission reducing system (described in U.S. Pat. No. 3,577,727) which improves driveability of an automobile. These embodiments have been described in detail and illustrated in the drawings. Claims to the invention follow.

I claim:

1. In a carburetor having a slidable member for varying the venturi cross-section and concurrently varying the amount of fuel metered into said venturi, the improvement which comprises a fuel enrichment device, said device comprising a vane located in said venturi, one end of which is pivotably mounted on the side wall of said venturi at a location opposite said slidable member and downstream of a fuel orifice, said vane being normally aligned with the axis of said venturi along said side wall, means for pivoting said vane in response to a decrease in intake manifold vacuum whereby the leading edge of said vane inclines toward said slidable member reducing the cross-section of said venturi.

2. The improvement of claim 1 wherein said leading edge of said vane has a lip extending toward said slidable member.

3. The improvement of claim 1 wherein said slidable member has a tapered needle extending from it and into a fuel orifice in said venturi whereby fuel is metered from said orifice in proportion to venturi cross-section.

4. The improvement of claim 2 wherein said vane is positioned in said venturi such that said leading edge is upstream from said fuel orifice.

5. The improvement of claim 4 wherein said leading edge has a lip extending toward said slidable member.

6. The improvement of claim 4 wherein said vane extends upstream past said fuel orifice, said vane having an opening adjacent said fuel orifice through which said tapered needle passes.

7. The improvement of claim 6 wherein said leading edge has a lip extending toward said slidable member.

* * * * *